US010869814B2

(12) United States Patent
Cudworth

(10) Patent No.: US 10,869,814 B2
(45) Date of Patent: Dec. 22, 2020

(54) NIPPLE AND NIPPLE ASSEMBLY

(71) Applicant: Mayborn (UK) Limited, New Castle Upon Tyne (GB)

(72) Inventor: Nicholas Cudworth, Cramlington (GB)

(73) Assignee: Maybom (UK) Limited, New Castle Upon Tyne (GB)

( * ) Notice: Subject to any disclaimer, the term of this patent is extended or adjusted under 35 U.S.C. 154(b) by 92 days.

(21) Appl. No.: 15/756,200

(22) PCT Filed: Aug. 25, 2016

(86) PCT No.: PCT/GB2016/052640
§ 371 (c)(1),
(2) Date: Feb. 28, 2018

(87) PCT Pub. No.: WO2017/037425
PCT Pub. Date: Mar. 9, 2017

(65) Prior Publication Data

US 2018/0250199 A1 Sep. 6, 2018

(30) Foreign Application Priority Data

Aug. 28, 2015 (GB) ..... 1515376

(51) Int. Cl.
*A61J 11/00* (2006.01)
*A61J 11/02* (2006.01)
(Continued)

(52) U.S. Cl.
CPC ..... *A61J 11/0035* (2013.01); *A61J 11/002* (2013.01); *A61J 11/004* (2013.01);
(Continued)

(58) Field of Classification Search
CPC ..... A61J 11/02; A61J 11/045; A61J 11/0035; A61J 11/002; A61J 11/0045; A61J 11/0065; A61J 11/001; A61J 11/006
(Continued)

(56) References Cited

U.S. PATENT DOCUMENTS 1,620,329 A 7/1926 Donaldson
3,145,867 A * 8/1964 Roberts ..... A61J 9/00 215/11.1

(Continued)

FOREIGN PATENT DOCUMENTS

CN 1261089 6/2006
CN 2877685 3/2007

(Continued)

OTHER PUBLICATIONS

International Search Report of International Application No. PCT/GB2016/052640.
Search Report of Application No. GB1515376.0.

*Primary Examiner* — Fenn C Mathew
*Assistant Examiner* — Jennifer Castriotta
(74) *Attorney, Agent, or Firm* — Fish & Richardson P.C.

(57) ABSTRACT

A nipple for use with an infant drinking cup is disclosed herein. The nipple comprises a domed portion having a central region and an inner surface, a teat portion radially offset from the central region, and a radially-outer wall. The radially-outer wall is joined to the domed portion at a joining location and comprises an inner fluid-flow surface, defining a fluid flow direction. A region of the inner surface of the domed portion at the joining location is substantially parallel to said fluid flow direction, or the inner fluid-flow surface of the teat portion extends radially outwardly, away from said region of the inner surface of the domed portion at the joining location.

10 Claims, 4 Drawing Sheets

(51) Int. Cl.
*A61J 11/04* (2006.01)
*A61J 9/06* (2006.01)

(52) U.S. Cl.
CPC ..... *A61J 11/02* (2013.01); *A61J 9/0623* (2015.05); *A61J 11/005* (2013.01); *A61J 11/0065* (2013.01); *A61J 11/04* (2013.01); *A61J 11/045* (2013.01)

(58) Field of Classification Search
USPC ..... 215/11.1, 11.4, 11.5, 714
See application file for complete search history.

(56) References Cited

U.S. PATENT DOCUMENTS 4,613,050 A 9/1986 Atkin et al.
6,253,935 B1 7/2001 Fletcher
7,556,172 B2 * 7/2009 Lane ..... A47G 19/2272 215/11.5
D617,465 S 6/2010 Hakim et al.
D634,439 S 3/2011 Hakim et al.
8,011,521 B2 * 9/2011 Clark ..... B65D 1/0223 215/11.1
8,215,504 B2 * 7/2012 Marr ..... A61J 11/0015 215/11.1
8,777,028 B2 7/2014 Sakulsacha
2004/0256345 A1 * 12/2004 Lundquist ..... A61J 11/0085 215/11.5
2006/0037927 A1 * 2/2006 Williams ..... A61J 9/00 215/11.1
2008/0210655 A1 * 9/2008 Rees ..... A61J 11/006 215/11.5
2009/0039046 A1 2/2009 Marr et al.
2011/0062105 A1 * 3/2011 Itzek ..... A61J 11/0015 215/11.5
2011/0121008 A1 * 5/2011 Lam ..... A47G 19/2272 220/711
2012/0305581 A1 12/2012 Dunn et al.
2013/0068715 A1 3/2013 Sakulsacha
2013/0200031 A1 * 8/2013 Rees ..... A61J 11/006 215/11.4
2014/0291272 A1 * 10/2014 Weil ..... A61J 9/00 215/11.5

FOREIGN PATENT DOCUMENTS

CN 101175463 5/2008
CN 1980626 11/2011
CN 103561711 2/2014
EP 1310230 5/2003
EP 2808006 3/2014
GB 2490735 11/2012
GB 2497590 6/2013
NZ 524766 10/2004
WO 0222073 3/2002
WO 2006103379 10/2006

* cited by examiner

NIPPLE AND NIPPLE ASSEMBLY

This application is a national filing under § 371 of International Application No. PCT/GB2016/052640, with an international filing date of Aug. 25, 2016, claiming priority from Great Britain Application No. 1515376.0, with a filing date of Aug. 28, 2015, all of which are herein incorporated by reference.

The disclosure relates to a nipple, nipple assembly and a bottle assembly.

Feeding bottles, typically comprising a bottle, a nipple (or teat) and a screw ring for mounting them together are well known. Research indicates that it is desirable to avoid the infant sucking air with milk from a feeding bottle as this is thought to lead to colic. As a result, the research currently indicates that it is preferable to feed the infant while the infant is relatively upright, for example at 45°, and to keep the teat full of liquid so that the baby doesn't suck air. Various approaches have been adopted to achieve this including angled feeding bottles and angled or offset teats. Various nipple configurations have also been disclosed, including a nipple with an elliptical cross-shape and a round teat with 'wings' to improve the seal with an infant's mouth. Non-conventional nipple configurations are in some instances used in conjunction with an offset teat portion of the nipple which ensures that as the bottle is tilted the teat portion is more likely to be filled hence reducing the risk of a baby ingesting air.

However, modern, wide-necked bottles of this type often suffer from liquid 'pooling' in the teat and/or the bottle, which leads to the teat portion being improperly filled and thus leads to an increased risk of the infant ingesting air.

A further problem is that modern, wide-necked teats are necessarily made from soft, flexible materials to provide a breast-like feel but their domed shape and thin walls mean the dome may be too easily deformed and prone to collapse or pushing back into the bottle.

An invention is set out in the claims. By providing a nipple having a radially offset teat portion in conjunction with an aligned inner surface of the nipple, a substantially flat flow surface is provided, ensuring reduced pooling as liquid traps are substantially reduced or eliminated.

Embodiments will now be described with reference to the Figures, of which:

Figure 8A:
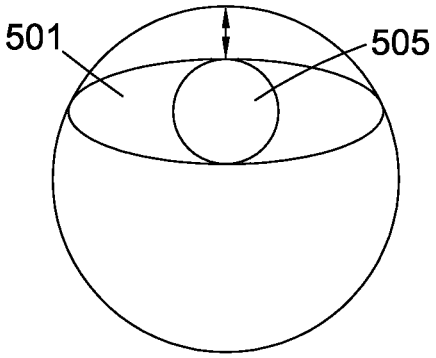

FIG. 8*a* shows a top view of a schematic of a nipple; and

Figure 8B:
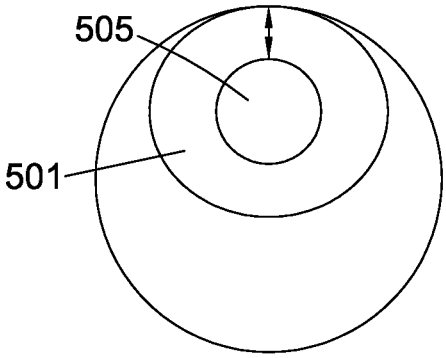

FIG. 8*b* shows a top view of a schematic of a nipple.

In overview, a nipple and bottle assembly is provided with enhanced feeding capability. The nipple includes a domed portion and a radially offset teat portion, as a result of which the teat portion will be better filled with liquid during feeding. According to an embodiment, the bottle has a very wide neck which in turn allows maximization of the offset of the teat portion. The screw ring can also be configured to provide maximized offset. As a result, when the bottle is in use, there is limited pooling of liquid in the domed (or 'areola') part of the nipple. Instead, the liquid can flow through the teat portion during feeding. This is enhanced by provision of a substantially flat surface within the nipple, aligned with the offset teat portion again reducing pooling. Yet further in view of the offset, the bottle surface can also be substantially aligned, providing throughflow of liquid from the bottle, through to the nipple and teat portion, again reducing pooling in either the bottle or the nipple.

A valve can be provided to equalize pressure within the bottle and the offset of the teat portion from the center of the nipple allows the valve to be offset in an opposite, or different, direction on the nipple surface. This enables the valve to be spaced as far away as possible from the teat portion hence reducing the risk of damage of or interference with the valve by the feeding infant. The nipple can be located in the screw ring by cooperating locating features ensuring that it is aligned correctly with the screw ring which in turn can then be aligned correctly with the bottle to ensure that the various parallel offset and/or flattened surfaces are in alignment.

Figure 1:
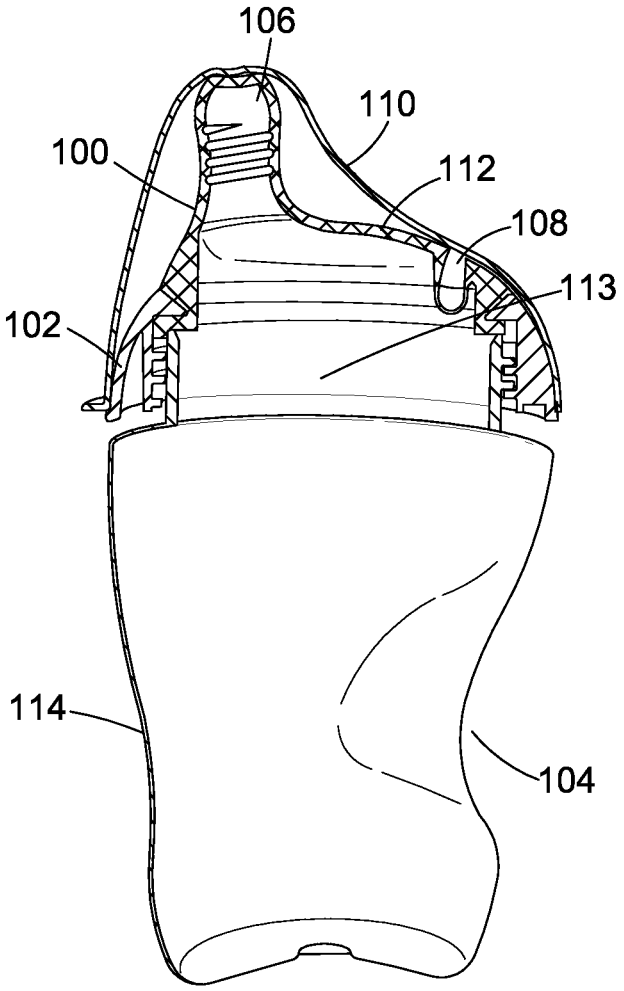
FIG. 1 shows a view of a bottle and nipple.

Referring now to FIG. 1, an embodiment comprising a bottle and nipple can be seen including a nipple 100, a screw ring 102, a bottle 104 and a cap 110. The nipple 100 includes a domed portion 112, a teat portion 106 and a valve 108.

The bottle includes at its upper end, a bottle neck 113 which defines an opening at the top of the bottle 104. The opening defined by the bottle neck 113 is substantially as wide as the widest part of the bottle itself allowing a wide neck nipple 100. This means that the teat portion 106 can be offset on the surface of the nipple 100 as close as possible to the wall of the bottle 104. This means that when the bottle is in feeding position the filling of the teat portion is enhanced during feeding. The bottle itself has an asymmetric design and in particular includes a flattened profile 114 aligned with the offset teat 106 minimizing pooling.

The valve 108 is provided in the nipple 100 at a periphery of the domed portion 112 offset radially opposite to, distal to, for example, the teat portion 106. As a result a maximum distance is placed between the nipple and the valve to avoid unwanted deformation or tampering of/with the valve by an infant and providing improved air venting. In an embodiment the valve is a duck-bill valve providing a high degree of sensitivity such that even a small pressure difference caused by sucking will be equalized to avoid any collapse of the wide nipple. For example a duck-bill valve of the type described in International patent application publication number WO 06103379, incorporated herein by reference, can be used or any other suitable type of valve or duck-bill valve.

In an embodiment, as shown in FIG. 1, the screw ring 102 is also configured to maximize the teat dimension hence allowing enhanced offset. In particular the provision of extra width and a more gentle outer circumference allows further maximization of the teat offset. Again this also permits the air vent to be spaced as far apart as possible from the teat portion 106.

Figure 2:
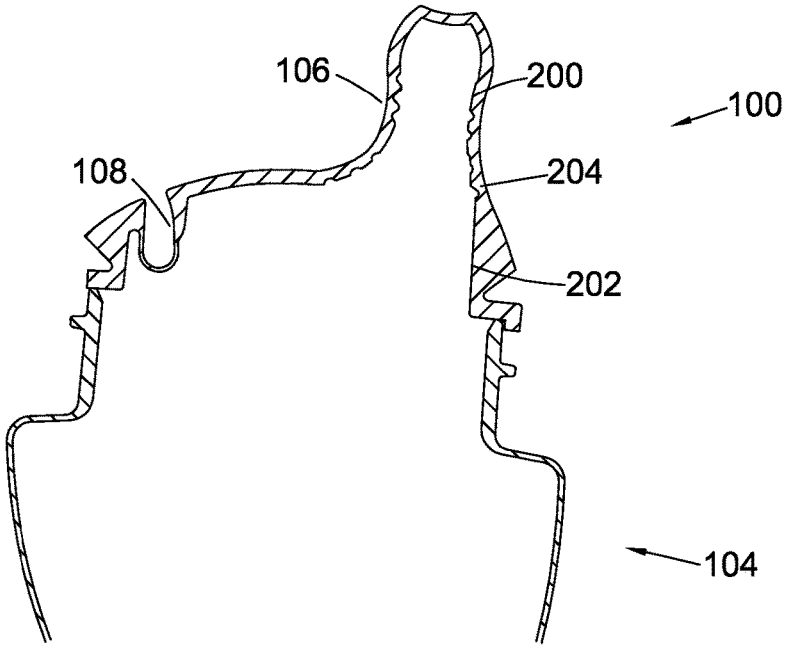
FIG. 2 is a cross section view of a nipple and a bottle.

Turning to FIG. 2, a nipple 100 is shown in more detail. The nipple shape is arranged to match the profile of a child's mouth for improved feeding, again reducing the risk of air intake. In the embodiment shown the base of the teat portion is circular in cross-section but alternatively can be oval or elliptical in cross-section. For example, an oval portion that is raised with respect to the main curved profile of the domed portion 112 of the nipple can be provided, wherein a substantially elongate teat portion extends from said oval portion. The significant separation between the teat portion 106 and the valve 108 can be clearly seen in FIG. 2. Additionally, the region of the domed portion 112 adjacent the teat portion 106 can be seen clearly therein. The teat portion has an inner fluid flow surface 200 (defined on the under-side of the teat) which defines a fluid flow direction in the feeding position (when the teat portion is effectively horizontal or at an angle tilted downwardly). The inner fluid flow surface 200 communicates with an inner surface 202 of the domed portion meeting at a joining location 204. It will be seen that the teat material is thickened in this region at the base of the teat portion 106 to provided alignment between the inner surfaces 200 and 202. According to an embodiment, the inner surface of the domed portion of the nipple portion is substantially flat in this region, thus enabling it to be parallel to, and possibly flush with, the inner fluid-flow surface of the teat portion. This enables a continuous, substantially straight flow of liquid from the claimed portion of the nipple, through the teat portion. In practice, there may be a slight discontinuing or 'step', in the radial distinction between the domed part of the nipple and the base of the teat. But, when compared to known bottle arrangements, such an embodiment will still reduce the incidents of pooling significantly, so that even when the bottle is held at a low or zero tilt, the teat portion can be filled effectively.

Figure 3:
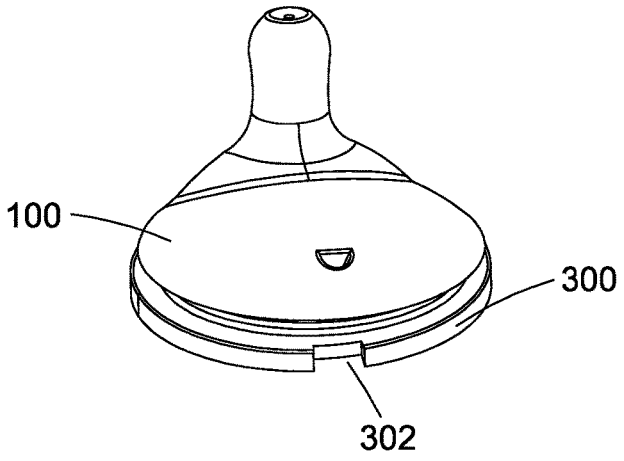
FIG. 3 shows a nipple having a locating feature.
Figure 4:
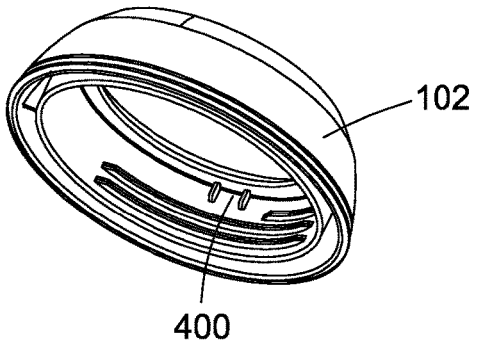
FIG. 4 shows a screw ring having a locating feature.

Referring to FIGS. 3 and 4, the manner in which the offset teat portion 106 can be aligned with the flattened portion 114 of the bottle to enhance fluid flow and reduce pooling yet further can be understood. In particular, the teat 100 includes a circumferential flange 300 at its lower end which is clamped to the rim of the bottle neck in use by the screw ring 102. The flange 300 includes a slot or interruption or cut out portion 302 along a part of the circumference. The cut out portion 302 aligns with one or more locating features 400 which can comprise projections on an inner surface of the screw ring 102. As a result when the nipple 100 is mounted to the screw ring 102 the cut out portion 302 and locating features aligned in the correct orientation. The screw thread of the screw ring 102 is formed so as to screw down to a predetermined rotational position relative to the bottle, clamping the flange 300 and orienting the cut out teat portion correctly. This can be further seen in FIG. 2 where the inner surface of the teat portion 200, inner surface of the domed portion 202 and flattened inner surface of the bottle 114 are all substantially aligned reducing pooling.

In FIGS. 5, 6, 7 and 8, a nipple is shown. The nipple comprises a domed portion 510. The domed portion has a raised elliptical portion 501, from which a teat 505 extends. The raised elliptical portion 501 is radially offset from the center of the domed portion 510. The teat 505 extends substantially from the center of the elliptical portion 501 in an upward direction. An inner surface of the elliptical portion 501 comprises a number of concentric grooves 503. Optionally, the grooves can extend into an inner surface of the teat portion 505 and/or the domed portion 510. The elliptical region may be positioned so that an outer circumference of the elliptical portion 501 contacts an outer circumference of the domed portion 510 at a contact region 507 of the periphery of the domed portion 510. A line or 'break' 502 is created where the elliptical section meets the domed section. The line 502 in the material of the domed portion marks the transition from the domed portion 510 to the elliptical portion 501, and the break 502 defines the outer perimeter of the elliptical portion.

Figure 5:
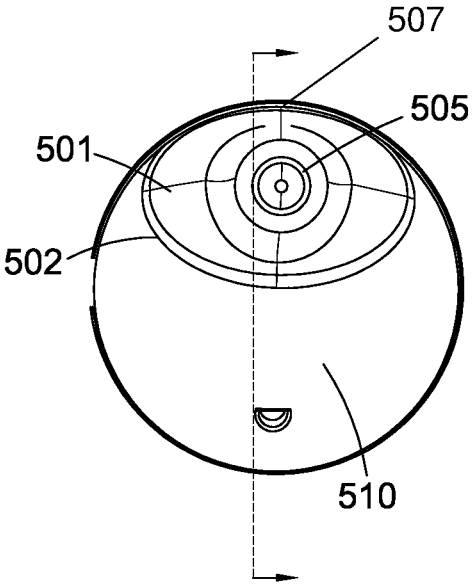
FIG. 5 shows a top view of a nipple.
Figure 6:
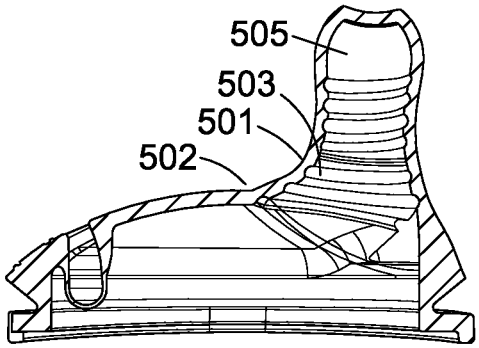
FIG. 6 shows a cross-section view of a nipple.
Figure 7:
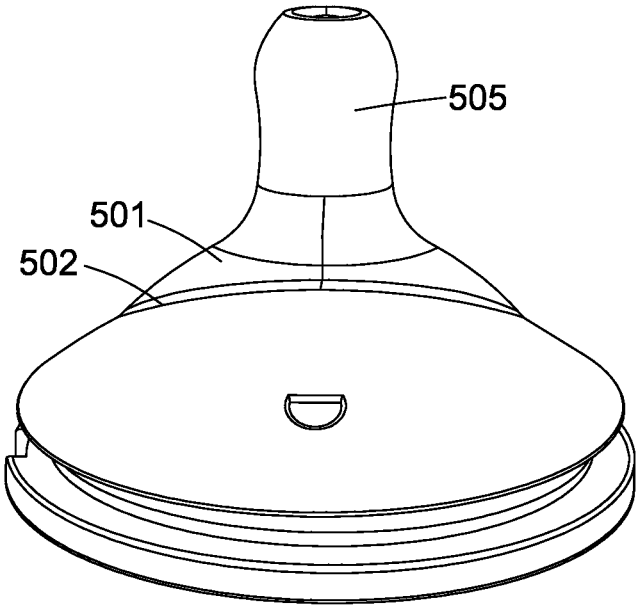
FIG. 7 shows a side view of a nipple.

The shape of the break 502 at the base of the elliptical portion 501 is preferably oval when viewed from the top, as shown in FIG. 5. More preferably, the ellipse is symmetrical about both its minor and major axes. The minor axis of the ellipse is aligned with a diameter of the nipple and the major axis is perpendicular to the minor axis. The length of the minor axis of the ellipse is preferably less than the radius of the domed section but greater than the widest diameter of the teat section.

With the length of the minor axis determined, the ratio of lengths of the major axis to minor axis is chosen so that the teat 505 is placed close to the outer perimeter of the nipple, while still substantially concentric with the ellipse. As shown in FIG. 8*a*, if the ratio is too large it will not be possible to place the teat section near the outer perimeter of the nipple. If the ratio is too small, as is shown in FIG. 8*b*, the same problem appears.

The ratio of lengths of the major axis to minor axis for the elliptical portion is preferably in the region of 2.5-3.5:1.5-2.5, more preferably in the region of 2.8-3.2:1.8-2.2, and even more preferably in the ratio of 3:2. In the arrangement of FIG. 5, the ratio of lengths of the major axis to minor axis is approximately 3:2, which provides an elliptical shape with the concentric teat section positioned close to the outer perimeter of the nipple.

The ellipse allows the teat section to be located in a position that minimizes pooling as described above in reference to FIG. 2. In known teat sections, it is common to have a round shape with a diameter in the region of 10-15 mm at the widest point. By providing a raised elliptical portion comprising, at its base, a distinct break with the domed section, the deformability of the domed shape can be modified. The break at the base of the domed section provides a strengthening feature across the dome. To compensate for this strengthening, the series of concentric grooves in the domed section, and optionally in the teat section, will add flexibility to the nipple in the region that goes into the baby's mouth. The combination of features allows a baby to suckle on a flexible, stretchable teat with a soft, wide domed surround section, but without unwanted deformation or collapse.

In operation, the nipple 100 is mounted into the screw ring 102 and located via the cooperating cut out portion and locating features in a desired rotational position. The bottle is filled and the screw ring is screwed down onto the bottle. In a clamped position the teat portion is aligned with the flattened portion of the bottle. When the bottle is then tilted for use, minimal liquid traps are provided, avoiding pooling by virtue of the alignment of the fluid flow surfaces. In particular pooling is stopped both within the teat, and is minimized between the teat and bottle.

The various components including the nipple, screw ring and bottle can be formed in any appropriate manner such as moulding and from an appropriate material. For example the bottle and screw ring can be made of polypropylene whereas the teat can be made of silicone or a thermoplastic elastomer. It will be noted that it would be possible to include the teat and screw ring in a single integral portion in some instances for example using co-moulding.

Although the disclosure is directed to feeding of an infant it would be appreciated that the same approach can be used in relation to other vessels where pooling is to be avoided including for example adult or animal feeding bottles.

The invention claimed is:

1. A nipple for a feeding bottle comprising:

a teat portion having an aperture and an inner fluid flow surface;

a domed base portion having an inner surface and connected to the teat portion at a joining location extending between the inner fluid flow surface of the teat portion and the inner surface of the domed base portion;

a flange having an inner surface and depending from the domed base portion, wherein a region of the inner surface of the domed base portion extending from the joining location to the flange does not become increasingly distal to a center axis of the nipple as it extends towards the flange;

a vent passage extending through the domed base portion opposite to the teat portion; and wherein the domed base portion further comprises a raised elliptical portion with a break at an intersection of an outer perimeter of the raised elliptical portion and of the domed base portion, wherein the raised elliptical portion has a minor axis aligned with a diameter of the nipple and a major axis perpendicular to the minor axis, and wherein the teat portion is substantially centered within the raised elliptical portion.

2. The nipple of claim 1 wherein a ratio of the major axis to the minor axis is chosen so that the teat portion is close to an outer perimeter of the nipple, but still substantially concentric within the raised elliptical portion.

3. The nipple of claim 1 wherein a ratio of lengths of the major axis to the minor axis is 3:2.

4. The nipple of claim 1 wherein a ratio of lengths of the major axis to the minor axis is between 2.5-3.5:1.5-2.5.

5. The nipple of claim 1 wherein a ratio of lengths of the major axis to the minor axis is between 2.8-3.2:1.8-2.2.

6. The nipple of claim 1 wherein an inner surface of the raised elliptical portion comprises concentric grooves.

7. The nipple of claim 6 wherein the concentric grooves extend into an inner surface of the teat portion.

8. The nipple of claim 1 wherein the raised elliptical portion is substantially oval shaped.

9. A bottle assembly for feeding comprising:

a nipple having:

a teat portion having an aperture and an inner fluid flow surface;

a domed base portion having an inner surface and connected to the teat portion at a joining location extending between the inner fluid flow surface of the teat portion and the inner surface of the domed base portion;

a flange having an inner surface and depending from the domed base portion;

a vent passage extending through the domed base portion, wherein the flange further comprises a slot substantially aligned with the vent passage;

a center axis that bisects the nipple in a central region such that the vent passage is on one side of the center axis and the teat portion is on the other side of the center axis, wherein a region of the inner surface of the domed base portion extending from the joining location to the flange does not become increasingly distal to the center axis as it extends towards the flange;

a bottle having an open bottle neck with a threaded portion, a closed bottom, and a body between;

a screw ring having an internally threaded portion having a locating feature and a downwardly domed peripheral portion surrounding and extending from a cylindrical portion;

the nipple being located in the screw ring by mating the slot in the flange of the nipple with the locating feature of the screw ring;

the nipple being secured to the bottle by capturing the flange of the nipple between the screw ring and the open bottle neck of the bottle; and wherein the domed base portion of the nipple further comprises a raised elliptical portion with a break at an intersection of an outer perimeter of the raised elliptical portion and of the domed base portion, wherein the raised elliptical portion has a minor axis aligned with a diameter of the nipple and a major axis perpendicular to the minor axis and wherein the teat portion is substantially centered within the raised elliptical portion.

10. The nipple of claim 9 wherein a ratio of the major axis to the minor axis is chosen so that the teat portion is close to an outer perimeter of the nipple, but still substantially concentric within the raised elliptical portion.

* * * * *